US010968067B2

(12) United States Patent
Carrion et al.

(10) Patent No.: US 10,968,067 B2
(45) Date of Patent: Apr. 6, 2021

(54) HEAVY DUTY TAPE DISPENSER

(71) Applicant: SHURTECH BRANDS, LLC, Avon, OH (US)

(72) Inventors: Heidi Carrion, Avon, OH (US); Aaron Misener, Lakewood, OH (US)

(73) Assignee: SHURTAPE TECHNOLOGIES, LLC, Hickory, NC (US)

( * ) Notice: Subject to any disclaimer, the term of this patent is extended or adjusted under 35 U.S.C. 154(b) by 0 days.

(21) Appl. No.: 16/289,338

(22) Filed: Feb. 28, 2019

(65) Prior Publication Data

US 2020/0277157 A1 Sep. 3, 2020

(51) Int. Cl.
*B65H 35/06* (2006.01)
*B65H 35/00* (2006.01)

(52) U.S. Cl.
CPC ..... *B65H 35/06* (2013.01); *B65H 35/002* (2013.01); *B65H 35/0073* (2013.01); *B65H 2701/1842* (2013.01)

(58) Field of Classification Search
CPC .. B65H 35/06; B65H 35/002; B65H 35/0073; B65H 2701/1842
See application file for complete search history.

(56) References Cited

U.S. PATENT DOCUMENTS 4,627,560 A * 12/1986 Samuelson ..... B65H 35/0026 225/66
4,961,525 A * 10/1990 Corbo ..... B65H 35/0026 225/56
5,071,051 A * 12/1991 Corbo ..... B65H 35/0026 225/56
5,328,115 A * 7/1994 Samuelson ..... B65H 35/002 242/588.6
5,820,005 A * 10/1998 Perkitny ..... B65H 35/0026 225/65
6,719,180 B2 * 4/2004 Shah ..... B65H 35/0026 225/56
6,874,554 B2 * 4/2005 Chandaria ..... B65H 35/0033 156/527
D588,646 S * 3/2009 Vulpitta ..... D19/69
8,474,504 B2 * 7/2013 Vulpitta ..... B65H 35/0033 156/577
D851,701 S * 6/2019 Carrion ..... D19/69
2007/0235494 A1 * 10/2007 Foran ..... B65H 35/0073 225/39
2009/0179061 A1 * 7/2009 Dureiko ..... B65H 35/0073 225/46

(Continued)

*Primary Examiner* — Omar Flores Sanchez
(74) *Attorney, Agent, or Firm* — Fay Sharpe LLP

(57) ABSTRACT

The present disclosure relates to tape dispensers that provide an easy to use locking mechanism for loading and unloading a roll of tape thereon. The dispenser includes a generally U-shaped frame with a pair of flexible sidewall arm portions that extend rearwardly in a generally side-by-side spaced apart relation. The dispenser includes inwardly facing opposed first and second hub portions that have a roll surface, a bottom surface, and an abutment surface, wherein the roll surface is configured to support the roll thereon. The frame also includes a pair of interlocking tabs disposed on the bottom surfaces hub portions. The tabs include a locking means for securing the hub portions together wherein the abutment surfaces of the first and second hubs are in direct contact.

19 Claims, 8 Drawing Sheets

(56) References Cited

U.S. PATENT DOCUMENTS

| | | | | |
|---|---|---|---|---|
| 2010/0018653 | A1* | 1/2010 | Dureiko | B65H 35/0073<br>156/510 |
| 2010/0084450 | A1* | 4/2010 | Vulpitta | B65H 35/0026<br>225/47 |
| 2012/0006497 | A1* | 1/2012 | Vulpitta | B65H 35/0073<br>156/510 |
| 2012/0006932 | A1* | 1/2012 | Chang | B65H 35/0026<br>242/598 |
| 2013/0264016 | A1* | 10/2013 | Vulpitta | B65H 35/0026<br>156/523 |
| 2013/0334273 | A1* | 12/2013 | Hagglund | B65H 35/0026<br>225/77 |
| 2016/0355366 | A1* | 12/2016 | Tiedemann | B65H 35/002 |
| 2017/0305705 | A1* | 10/2017 | Yu Chen | B65H 35/0073 |

* cited by examiner

HEAVY DUTY TAPE DISPENSER

BACKGROUND

The present disclosure relates to a dispensing device for tape rolls. It finds particular application in conjunction with hand-held tape dispensers from which tape may be dispensed and severed from tape remaining on the roll in the dispenser, and will be described with particular reference thereto. However, it is to be appreciated that the present exemplary embodiments are also amenable to other like applications.

Dispensers for pressure-sensitive tapes usually comprise an integral molded plastic frame of U-shape and include a planar tape guide wall and a tape severing portion. A pair of flexible tape roll support arms extend in spaced, generally parallel relation from opposite sides of the severing portion. The support arms can be formed with opposed C-shaped hub portions at a location spaced from and more or less centered on an axis in the plane of the guide wall portion. The hub portions are inwardly facing and axially aligned for rotatably supporting a roll of tape thereon.

While such tape dispensers perform satisfactorily to dispense tape wound on cores having a comparatively small size central opening such as 1½ inches, dispensers sized to dispense tape wound on considerably larger diameter cores, e.g., cores having a 3 inch diameter central opening, have been found to be unstable when used to dispense or cut tape, particularly where the tape is of a type difficult to cut such as heavy-duty packaging tape with increased mil thickness.

Some difficulty in cutting the tape is attributed to the end user squeezing the dispenser during use, which causes the tape roll to brake and become more difficult to dispense the tape. Thus, it is desirable to provide an improved tape dispenser to protect the tape roll from braking, where the tape roll will still function when squeezed. Some devices solve this problem by including a thick interior rib structure to resist the squeezing. However, this requires additional material, stiffens the device, and adds visual features (ribs) that may not be visually appealing to customers or limit the placement of markings on the dispenser for advertising.

U.S. Pat. Nos. 4,961,525 and 5,071,051 (the disclosures of which are herein incorporated by reference) teach a releasable locking means for firmly joining the hub portions together to rigidify the dispenser. This design, however, includes a locking means that is covered when a roll of tape is placed on the dispenser, potentially making it difficult for removing of the tape roll.

U.S. Pat. No. 4,627,560 (the disclosure of which is herein incorporated by reference) teaches a tape dispenser for three inch cores. In one embodiment, the dispenser device includes a rib insertable into a slot defined by walls to lock the hub portions together. This design suffers from drawbacks in that the dispenser must be twisted to attach and detach the rib from the slot. This motion is difficult for some users and can cause damage of the dispenser. Furthermore, the mechanism of the U.S. Pat. No. 4,627,560 patent for locking the dispenser is hidden under the roll. Thus, users may experience increased difficulty in detaching a tape due to the fact the user cannot see the locking mechanism nor appreciate a tactile feel.

The disclosure provides certain improvements.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

In accordance with some aspects of the present disclosure, a device for dispensing and severing an adhesive tape from a roll includes a generally U-shaped frame including a forward tape guide portion. The forward tape guide portion has a generally planar top tape guide surface, a front edge, a first side edge and a second side edge. The frame also includes first and second flexible sidewall arm portions. The sidewall arm portions are disposed generally perpendicular to the generally planar top guide surface and extend rearwardly in a generally side-by-side spaced apart relation from the first side edge and second side edge, respectively. The first and second flexible sidewall arm portions each have an interior surface and an exterior surface. The frame also includes inwardly facing opposed first and second hub portions that project from the interior surface of the first and second flexible sidewall arm portions, respectively. The first and second hub portions are generally of arcuate shape having a roll surface, a bottom surface, and an abutment surface. The abutment surface connects the roll surface to the bottom surface. The roll surface is configured to support a roll of tape thereon. The frame also includes a first tab disposed on the bottom surface of the first hub portion that extends inwardly toward the second hub portion. The first tab includes a passage configured to receive a projection disposed on the bottom of the surface of the second hub portion. The frame also includes a second tab disposed on the bottom surface of the second hub that is spaced apart from the projection and extends inwardly toward the second hub configured to slidably contact the bottom surface of the first hub. When the first tab is engaged with the projection, the abutment surfaces of the first and second hubs are in contact.

In accordance with another aspect of the present disclosure, a device for dispensing and severing an adhesive tape from a roll includes a U-shaped frame having a forward tape guide portion. The forward tape guide portion having a generally planar top tape guide surface, a front edge, a first side edge and a second side edge. The frame also includes first and second flexible sidewall arm portions disposed generally perpendicular to the generally planar top guide surface and extending rearwardly in a generally side-by-side spaced apart relation from the first side edge and second side edge, respectively. The first and second flexible sidewall arm portions each have an interior surface and an exterior surface. The frame also includes inwardly facing opposed first and second hub portions that project from the interior surface of the first and second flexible sidewall arm portions, respectively. The first and second hub portions generally are of arcuate shape having a roll surface, a bottom surface, and an abutment surface. The abutment surface connects the roll surface to the bottom surface and the roll surface is configured to support a roll of tape thereon. The frame also includes a first tab having angled sidewalls and is disposed on the bottom surface of the first hub portion extending inwardly toward the second hub portion. A second tab having angled sidewalls complementary to the angled sidewalls of the first tab is disposed on the bottom surface of the second hub extending inwardly toward the first hub configured to slidably contact the bottom surface of the first hub. The first tab includes a locking structure configured to engage a complementary locking structure located on the bottom surface of the second hub portion such that when the locking structure is engaged with the complementary locking structure the abutment surfaces of the hub are in direct contact.

In accordance with another aspect of the present disclosure methods for loading and unloading a roll of tape from a tape dispenser are provided. The method includes providing a dispenser frame with a forward tape guide portion having a generally planar top tape guide surface, a front edge, a first side edge and a second side edge. The dispenser includes first and second flexible sidewall arm portions disposed generally perpendicular to the generally planar top guide surface and extending rearwardly in a generally side-by-side spaced apart relation from the first side edge and second side edge, respectively, the first and second flexible sidewall arm portions each having an interior surface and an exterior surface. The dispenser also includes inwardly facing opposed first and second hub portions projecting from the interior surface of the first and second flexible sidewall arm portions, respectively; the first and second hub portions of generally arcuate shape having a roll surface, a bottom surface, and an abutment surface, wherein the abutment surface connects the roll surface to the bottom surface, and wherein the roll surface is configured to support the roll thereon. Also, the dispenser has a first tab having angled sidewalls disposed on the bottom surface of the first hub portion extending inwardly toward the second hub portion and a second tab having angled sidewalls complementary to the angled sidewalls of the first tab disposed on the bottom surface of the second hub spaced apart from the projection extending inwardly toward the second hub configured to slidably contact the bottom surface of the first hub. The first tab includes a locking structure configured to engage a complementary locking structure located on the bottom surface of the second hub portion such that when the locking structure is engaged with the complementary locking structure the abutment surfaces of the hub are in direct contact. The method further includes manipulating, via a finger of a user, the first tab such that the locking structure and complementary locking structure disengage allowing for the hub portions to be separated by a distance such that a roll of tape may be installed or removed from the dispenser.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
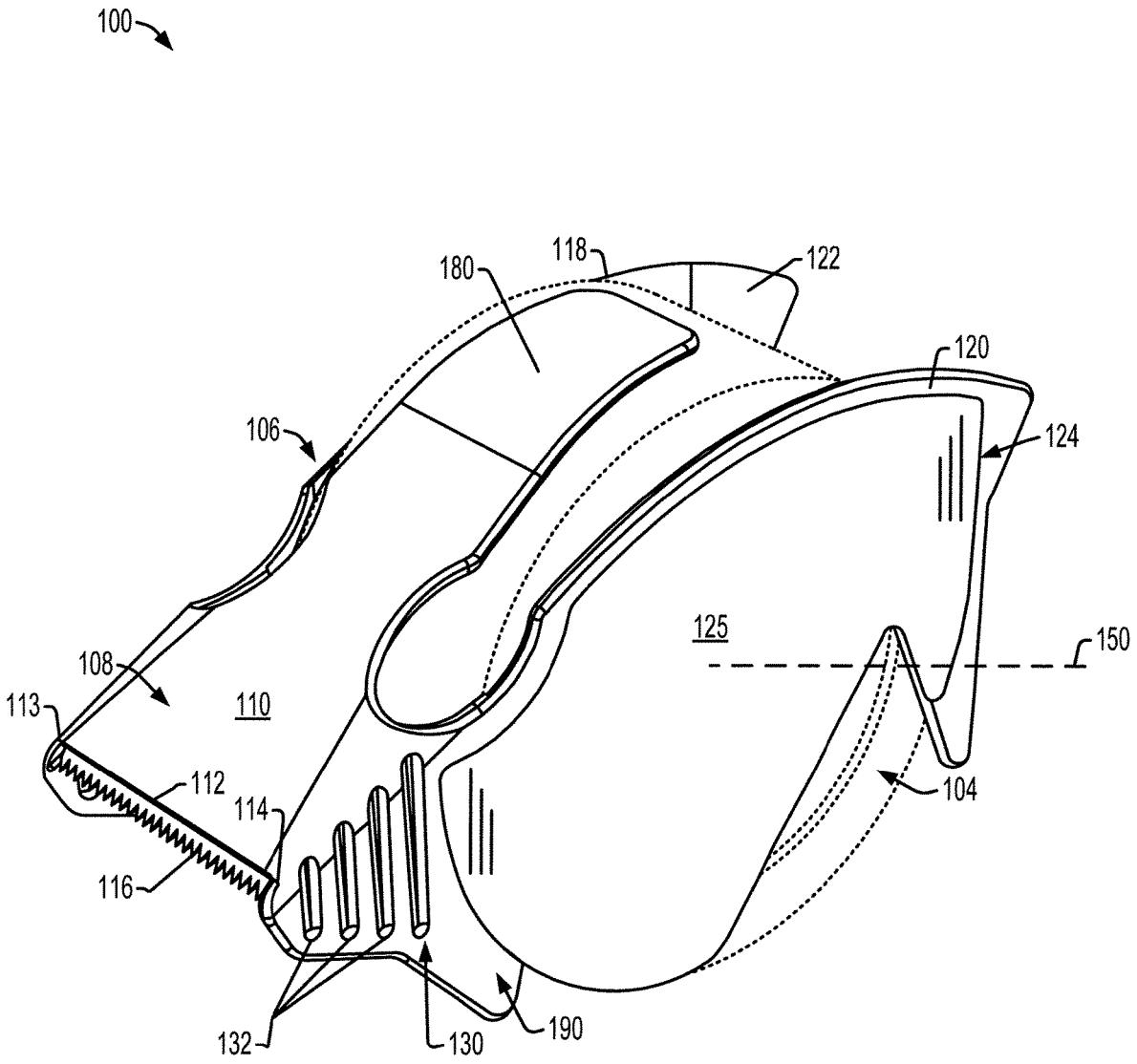
FIG. 1 illustrates a top perspective view of a tape dispenser in accordance with the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used herein, the terms about, generally and substantially are intended to encompass structural or numerical modifications which do not significantly affect the purpose of the element or number modified by such term.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any impurities that might result therefrom, and excludes other ingredients/steps.

The present disclosure relates to devices for dispensing tape. The tape dispenser is configured to receive and rotatably hold a roll of tape such that a length of tape may be unwound from the roll and applied to an application surface. The tape dispenser may be a handheld tape dispenser that facilities dispensing tape at the point of application. The dispenser is also able to be used as a standing dispenser when properly oriented, wherein a length of tape may be advanced and severed while the device is resting on a surface.

Typically, adhesive tapes include a carrier film with an adhesive layer disposed on at least one surface of the carrier film. Carrier films include but are not limited to cloth, plastic films, papers, mesh and/or metal foils. The carrier film with the applied/coated adhesive layer may be wrapped around a core or itself such that a roll of the adhesive material on the carrier film (tape) is formed. The thickness of the carrier film and adhesive layer is generally related to the force required to tear and/or cut a portion of the tape material from the roll. Some applications require the carrier film to be thick and resistant to tearing or warping when applied to an application surface. This is especially the case when the tape is used to join two application surfaces together. For example, a thick tape may be required in packaging applications for closing the bottom lids of a box in order to prevent the tape from tearing under a load and releasing any contents contained within the box.

Since thick tapes may require more force to separate a portion of unwound tape from a tape supply such as a roll, a dispenser must be able to accommodate those forces and be able to apply the heavy duty tape in an even manner without braking. Braking may occur when a user struggles to apply a tape and grips the sides of the dispenser with increased force. The sides arms of the tape dispenser may contact the supported tape roll and prevent the tape roll from rotating and advancing tape.

In accordance with the present disclosure and with reference to FIG. 1, a device 100 for dispensing and severing an adhesive tape 102 from a tape roll 104 includes a generally U-shaped shaped frame 106. The "U" shape of the U-shaped frame 106 is best illustrated in the top view of the device 100 in FIG. 2. The frame 106 includes a forward tape guide portion 108. The forward tape guide portion 108 has a generally planar top tape guide surface 110 and a front edge 112 having a first side and second side, 113 and 114, respectively. As tape is advanced and pulled from the roll 104 the front tape guide portion 108 helps to direct the tape 102 in a straight path while it is unraveled from the tape roll 104. Thus, movements and stresses that cause the tape to warp or fold are minimized and the tape may be dispensed on an application surface evenly, straight, and without defects.

The forward tape guide portion 108 may include a cutting blade 116 disposed along a length of the front edge 112. The cutting blade is a sharp edge that facilitates separating a length of tape from the roll of tape 104. The cutting blade 116 may be a sharp edge razor blade, a serrated blade, or any shape of blade known in the art to cut an adhesive material and/or carrier film. The blade 116 is generally not in contact with the tape 102 as it is dispensed. Rather the blade 116 makes contact with dispensed tape and causes the dispensed tape to sever from the roll of tape 104 when the dispenser 100 is manipulated by a user via a rotation of the device 100 about axis 150, to cause blade contact with the tape.

The U-shaped frame 106 of the dispenser 100 also includes first and second sidewall arm portions 118 and 120, respectively. The sidewall arm portions 118 and 120 are disposed generally perpendicular to the generally planar top guide surface 110. The first sidewall arm portion 118 and second sidewall arm portion 120 extend rearwardly in a generally side-by-side spaced apart relation from the first side 113 and second side 114, respectively, of the front tape guide portion 108.

In some embodiments, the sidewall arm portions 118 and 120 are flexible arms. In this way, the sidewall arm portions 118 and 120 may be manipulated ("flexed") to facilitate the installation or removal of a roll of tape 104 from the device 100. The flexible arm portions may be resilient such that shape of the device 100 is not distorted nor is the device damaged upon flexing the flexible sidewall arms.

The first and second sidewall portions each have and interior surface 122 and an exterior surface 124. The interior surface 122 of each sidewall portion 118 and 120 are opposing surfaces, meaning that the interior surface of the first sidewall portion 118 faces the interior surface of the second sidewall portion 120, and vice versa. The exterior surface 124 of each sidewall portion 118 and 120 face away from each other and are considered to be part of the outside surface of the dispenser 100.

In some embodiments, at least one of the exterior surfaces 124 is configured to accept a label 125. That is, an adhesive label may be placed on at least one exterior surface 124 for marketing purposes. In other embodiments, in place of a label at least one exterior surface 124 may printed, marked, or stamped.

In some embodiments, the exterior surfaces 124 of the device 100 may include a gripping portion 130 located near the front tape guide portion 108. The gripping portion 130 may impart an increased frictional feel to the device 100 such that a user's hand and fingers stay in place (i.e. they do not slip) while operating the tape dispenser. The gripping portion 130 may also impart increased ergonomic feel to the device such that the device 100 is more comfortable in the user's hand.

The gripping portion 130 may be molded into the device during creation or may be added to the device after a molding/creation process. The gripping portion 130 may be designed to accommodate user's hand for manipulating the device 100. In some embodiments, the gripping portion may include a series of ribs or channels 132 disposed on the exterior surface 124. In these embodiments, the ribs and channels may also increase the stiffness and strength of the material without increasing the thickness of the frame 106. In other embodiments, the gripping portion 130 may include a plurality of bumps, divots, or any combination of embossed or raised shapes.

In other embodiments, a gripping material may be applied to the exterior surface 124. As a non-limiting example, a polymer material may be adhered to the exterior surfaces 124 to enhance the feel or frictional properties of the device 100.

In some embodiments and with continued reference to FIG. 1, the device 100 includes a tape brake 180 extending from the tape guide portion 108. The tape brake 180 is cantilevered arched portion connected to, and integral with, the front tape guide portion 108, but is not as wide as the tape guide portion 108. Thus, the tape brake 180 is not connected to the flexible sidewall arm portions 118 and 120 at all. Rather, there is a gap 181 between the sides of the tape brake 180 and the sidewall arm portions 118 and 120 over the entire length of the tape brake 180. In some embodiments, the tape brake 180 tapers from its widest portion adjacent the tape guide portion 108 to a narrower portion above and slightly behind the axis 150 of the tape roll 104. As can be seen in FIG. 1, the tape brake 180 is generally straight in the transverse direction and roughly follows the convex shape of the top of the roll of tape 104 in the direction from front to rear of the tape dispenser 100.

Figure 2:
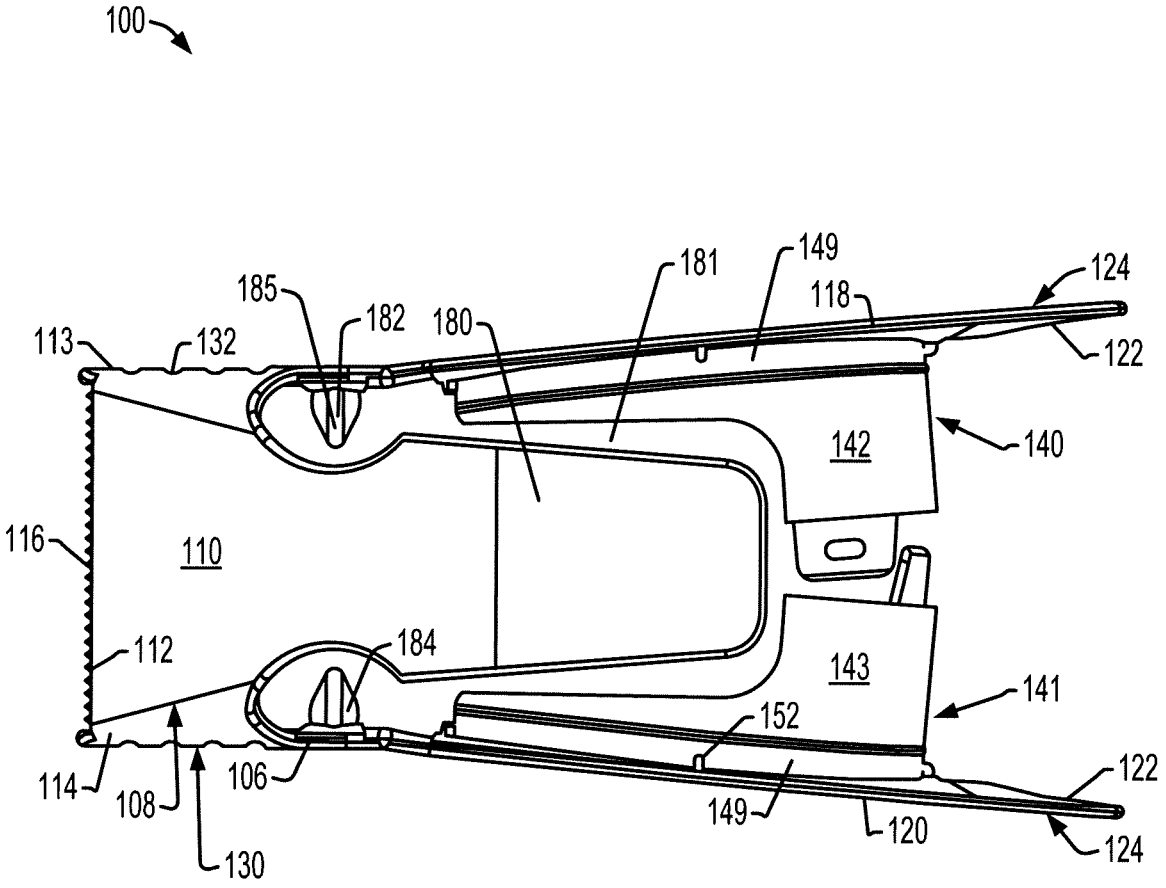
FIG. 2 illustrates a top plan view of a tape dispenser in accordance with the present disclosure.
Figure 3:
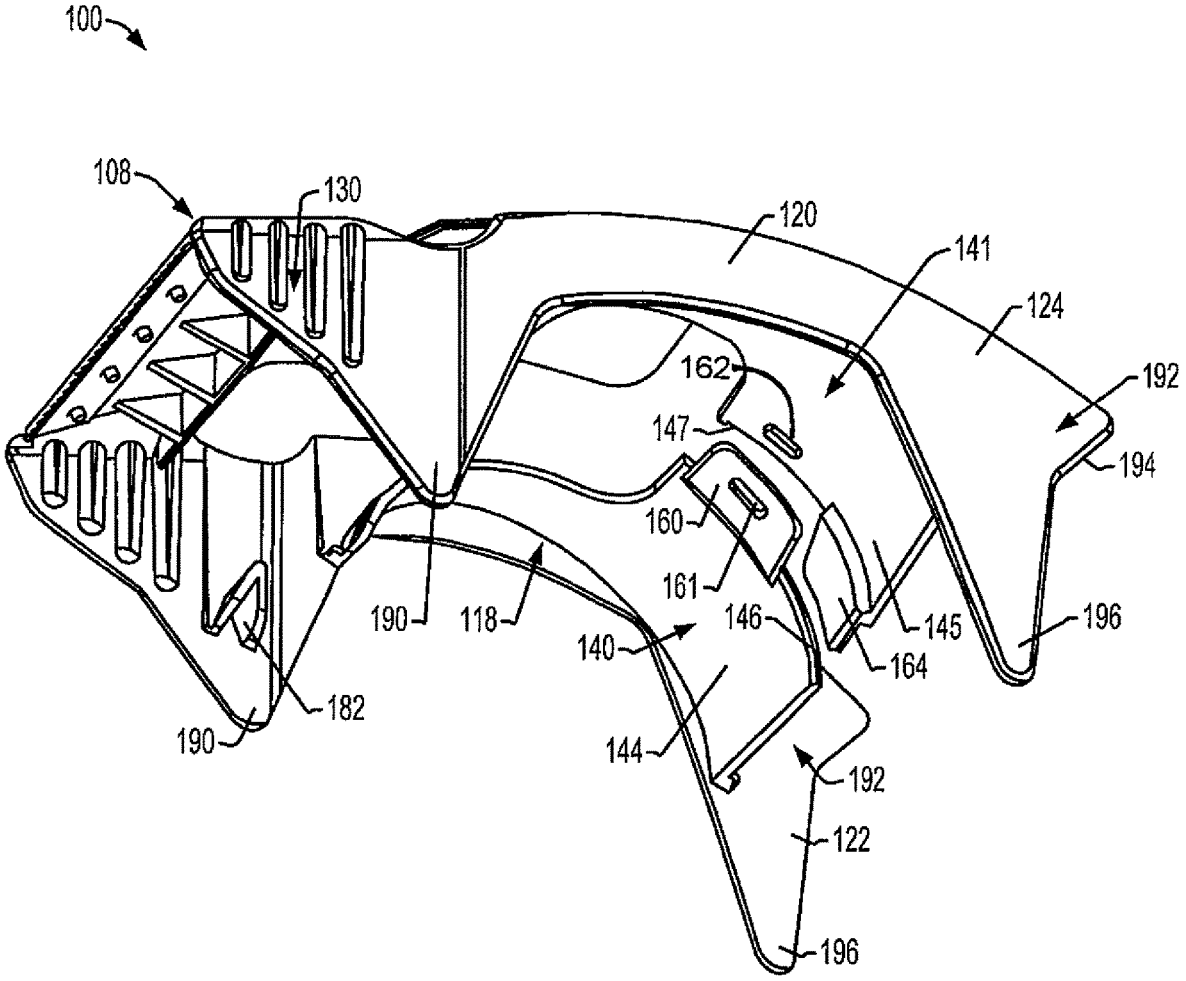
FIG. 3 illustrates a bottom perspective view of a tape dispenser in accordance with the present disclosure.

In some embodiments and with reference to FIGS. 2-3, the tape dispenser 100 further includes tape retaining tabs 182 and 184 which project inwardly from the respective first and second sidewall arm portions 118 and 120. The top surfaces of the retaining tabs 182 and 184 are generally convex and may include least one ridge 185. In operation, tape is advanced from the roll of tape 104 and threaded above the tape retaining tabs 182 and 184. The ridges 185 minimize the area of contact between the adhesive side of the advanced tape and the tape retaining tabs 182, 184. This allows the tape 102 to slide over the tape retaining tabs 182, 184 without sticking or binding but still be retained above the tape retaining tabs 182, 184 both during dispensing and while at rest.

With reference to FIGS. 2-3, the device 100 includes a first hub portion 140 and second hub portion 141. The hub portions 140 and 141 project inwardly from the interior surfaces 122 of the first and second sidewall arm portions 118 and 120, respectively. The first and second hub portions 140 and 141 are generally arcuate in shape and include roll surfaces 142 and 143 respectively, bottom surfaces 144 and 145, respectively and abutment surfaces 146 and 147, respectively. The abutment surfaces 146 and 147 connect the roll surfaces 142 and 143 to the bottom surfaces 144 and 145, respectively.

The roll surfaces 142 and 143 are configured to support a roll of tape 104 thereon. When the abutment surfaces 146 and 147 are in direct contact such that the roll surfaces 142 and 143 combine to create an almost continuous surface, the tape roll 104 rests on the combined roll surfaces of the hub portions 140 and 141. The roll surfaces 142 and 143 allow the roll of tape 104 to slide about the surface such that the tape roll 104 may rotate with respect to the center axis 150 of the roll of tape 104. In this way, when tape is advanced through the tape guide portion 108, the tape roll 104 is allowed to rotate such that more tape 102 is fed out the device 100.

Figure 4:
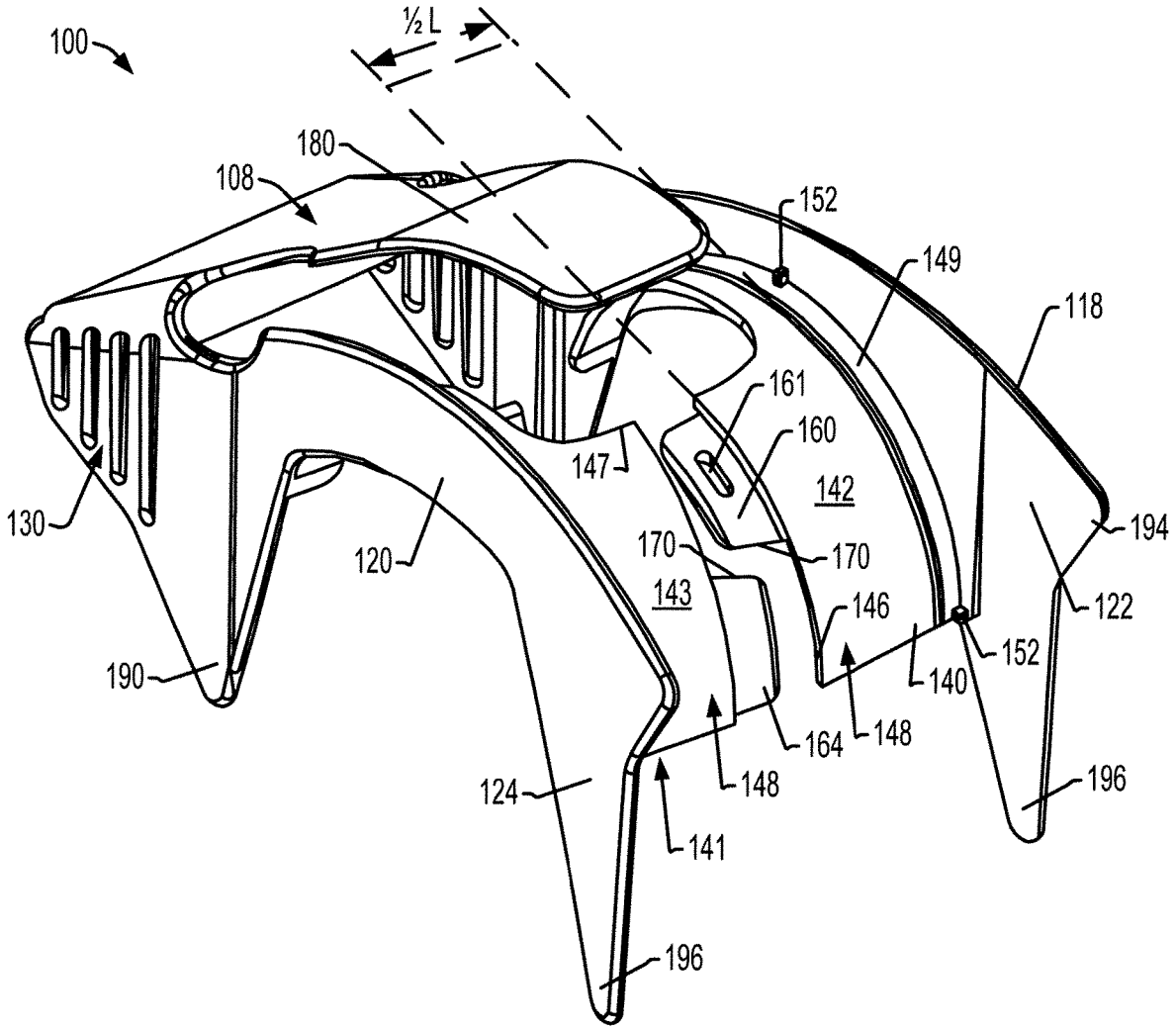
FIG. 4 illustrates a rear perspective view of a tape dispenser in accordance with the present disclosure.

In some embodiments and with reference to FIG. 4, the roll surfaces 142 and 143 of the first and second hub portions include a central recess 148 configured to receive a roll of tape 104. The recess 148 is defined by a pair of ridges 149 located on the edges of the central recess 148 and adjacent to the interior surfaces 122 of the sidewall arm portions 118, 120. The recess is dimensioned to secure a received roll of tape 104 between the ridges 149. In this way, side to side movement of the tape roll 104 during dispensing is minimized. In some embodiments, when the hub portions are in a locked position, the central recess has a width L of about 3 inches. Said another way, each hub portion includes a recess dimensioned with a width of ½ L such that when the abutment surfaces of each hub are in contact, a continuous roll surface is formed from the combination of roll surfaces 142 and 143.

In some embodiments, the roll surfaces 142 and 143 include a plurality of side spacers 152 located about the boundary where the hub portions contact the interior sidewall surfaces 122. In embodiments wherein the hub portions include ridges 149, the side spacers 152 are disposed on the ridges 149 and in contact with the interior sidewall surfaces 122.

With reference to FIGS. 3-4 the device 100 includes a first tab 160 disposed on the bottom surface 144 of the first hub portion 140. The first tab extends inwardly and toward the second hub portion 141. The first tab 160 includes a first tab structure 161 configured to engage a complementary first tab structure 162 located on the bottom surface 145 of the second hub portion 141 such that the first and second hub portions 140 and 141 are locked together. In the locked position, the corresponding abutment surfaces 146 and 147 of the first and second hub portions 140 and 141 are in direct contact.

In some embodiments, the first tab structure 161 and complimentary first tab structure 162 are a passage and projection, respectively. The projection 162 is disposed on the bottom surface 145 of the second hub portion 141 opposite of the first tab 160. The first tab 160 includes a passage 161 configured to receive the projection 162 of the second hub. The passage 161 may be in the form of an elongated slot. The first tab 160 is configured to sildably contact the bottom surface 145 of the second hub portion 141. When the abutment surfaces 146 and 147 are in contact with each other, the first tab 160 is able to engage the projection 162. When the first tab engages the projection 162, the hub portions lock together.

It is to be appreciated that the locking structures described herein for the first tab and bottom surface of the second hub portion may be reversed. That is, for example, the first tab 160 may include a projection and the second hub portion 120 may include a complementary passage for receiving the projection.

With continued reference to FIGS. 3-4, the bottom surface 145 of the second hub portion 141 includes a second tab 164 that extends inwardly and toward the first hub portion 140. The second tab is configured to sildably contact the bottom surface 144 of the first hub portion 140.

In some embodiments, the second tab 164 includes a second tab structure configured to engage a complementary second tab structure located on the bottom surface 145 of the second hub 141 such that locking structures aid in locking the first hub portion 140 and second hub portion 141 together.

In some embodiments, the tabs 160 and 164 have adjacent interlocking complementary side angled sidewalls 170. That is, the tabs 160 and 164 may be trapezoidal in shape wherein the lateral side of one tab is complementary with the lateral side of the other tab. The angled sidewalls 170 of each tab encourage the alignment of the passage 161 with the projection 162 during installation of a roll of tape 104.

Figure 5:
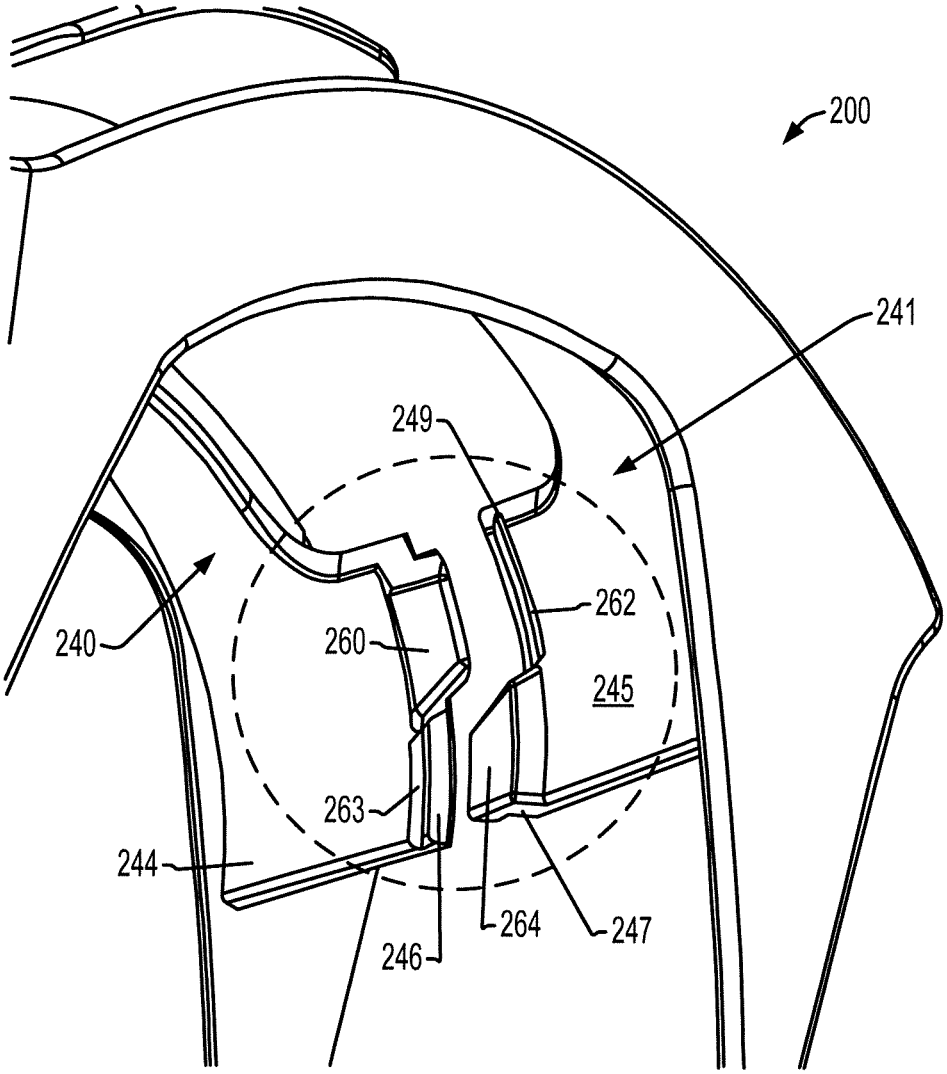
FIG. 5 illustrates a side view of a tape dispenser resting on a surface in a resting orientation.
Figure 6:
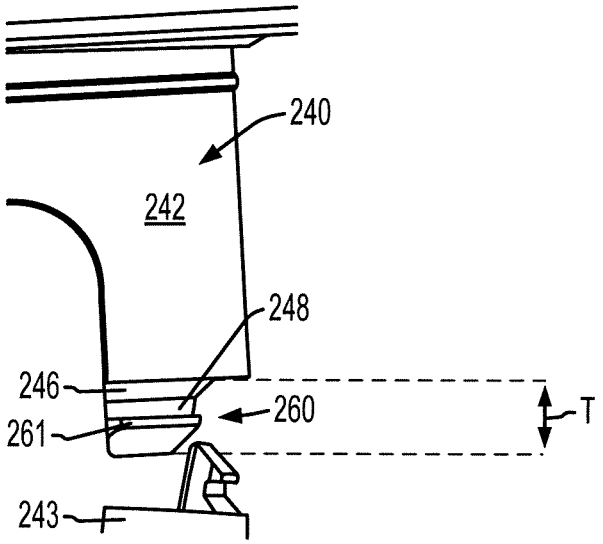
FIG. 6 illustrates a side perspective view of a tape dispenser resting on a surface in another resting orientation.

In some embodiments, and with reference to FIGS. 5-6 the device 200 includes a first tab 260 disposed on the bottom surface 244 of the first hub portion 240. The first tab 260 extends inwardly and toward the second hub portion 241. The first tab 260 includes a first tab projection 261 configured to engage a complementary hub channel 262 located on the bottom surface 245 of the second hub portion 241 such that the first and second hub portions 240 and 241 are locked together. In the locked position, the corresponding abutment surfaces 246 and 247 of the first and second hub portions 240 and 241 are in direct contact.

Figure 7:
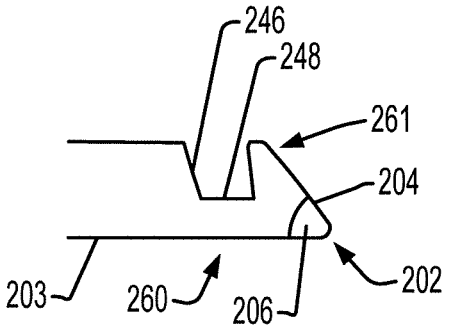
FIG. 7 illustrates a first tab projection sidewall angled with respect to the bottom surface of the dispenser.
Figure 8:
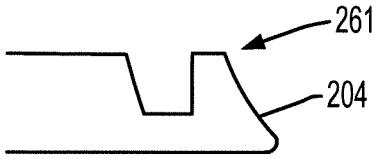
FIG. 8 illustrates the first tab projection sidewall with a curved cross-section.

More particularly in some embodiments and with reference to FIGS. 5-7, the first tab 260 has a first tab end 202 and a bottom tab surface 203. The first tab projection 261 includes a first tab projection sidewall 204 that connects to the bottom tab surface 203 about the first tab end 203. In some embodiments and as illustrated in FIG. 7, the first tab projection sidewall 204 is angled with respect to the bottom surface 203 at an angle 206. The angle 206 may range from greater than about zero degrees to less than about 90 degrees, including 30, 45, 60 degrees and any angle therebetween. In some embodiments, the first tab projection sidewall 204 has a linear cross-section, that is the cross-section appears as a straight line. In other embodiments and as illustrated in FIG. 8, the first tab projection sidewall 204 has a curved cross-section.

With reference back to FIGS. 5-7, the first tab 260 also includes a first tab channel 248 located between the abutment surface 246 and first tab projection 261. The first tab channel 248 is configured to engage a first hub projection 249 such that the abutment surface 246 of the first tab 260 is in contact with the abutment surface 247 of the second hub. In some embodiments, the abutment surface 246 is angled with respect the bottom tab surface 203 and the abutment surface 246 is correspondingly angled such that the abutment surfaces 246 and 247 are in substantially complete contact with one another.

With continued reference to FIGS. 5-7 the bottom surface 245 of the second hub portion 241 includes a second tab 264 that extends inwardly and toward the first hub portion 240. The second tab 264 is configured to sildably engage the bottom surface 244 of the first hub portion 240.

In some embodiments, the second tab 264 is configured in a similar manner to first tab 260. That is, the second tab 264 also includes a second tab projection (analogous to first tab projection 261), a second tab bottom surface (analogous to first tab bottom surface 203), a second tab end (analogous to first tab end 202), a second tab sidewall (analogous to first tab sidewall 204), a second tab channel (analogous to first tab channel 248), and an abutment surface (analogous to abutment surface 246). The first hub 240 is configured analogous to the second hub 241, such that the first hub 240 may receive and engage the second tab 264. That is the first hub 240, includes a hub projection (analogous to hub projection 249), a hub channel 263, and an abutment surface (analogous to abutment surface 247). Stated another way, the device may include identical offset opposing tabs 260 and 264 each projecting inwardly from opposing hubs 240 and 241, respectively.

In some embodiments, the length T of a tab, such as tab 160 and 260, is less than about 0.5 inches in length. In other embodiments, the length T is less than or equal to about 0.35 inches. In still yet other embodiments, the length T is less than or equal to about 0.2 inches. In some embodiments, the length T less than 0.35 inches to allow for a tape roll to be loaded into the assembly, either by users reusing the assembly or by the manufacturer's equipment loading the tape dispenser for sale.

Because the mechanisms for locking the hubs together are disposed on the bottom surfaces 144 and 145 (244, 245) of the hub portions, the locking mechanism is not covered when a roll of tape 104 is installed on the hubs. In this way, a user has easy access to the locking mechanism as a user's finger may access the tabs and locking mechanism via access area 195. In the case where the tab includes a passage and the hub includes a projection, a user may manipulate the tabs with a finger, such as by applying a lifting motion to the tab and unlock the hub portions. With the hubs no longer locked, the flexible arm portions 118 and 120 may be easily manipulated by simply separating the two to either install or remove a tape roll.

A device with a hidden locking mechanism (i.e. hidden by the tape roll) requires a user to twist or stress the flexible arm portions until the hubs unlock. This is undesirable as the twisting and stress could damage the dispenser. Rather in the devices of the present disclosure, the tabs 160 and 164 (260 and 264) themselves give a tactile quality to the locking mechanism that allows for easy manipulation.

The contacting abutment surfaces 146 and 147 (249, 247) in cooperation with the foregoing tab locking mechanisms, protect the tape roll to prevent accidental braking when a user squeezes the sidewalls of the dispenser during use. That is, the abutment surfaces help prevent the device from collapsing inward in response to pressure applied by a user.

The U-shaped frame 106 of the tape dispenser 100, that is the sidewalls portions 118 and 120 and tape guide portion 108, are molded as a unit. In some embodiments, the sidewalls are provided with gentle tapers, or draft, to facilitate molding. The tape dispenser is molded from a polymer material which has appropriate flexibility and stiffness characteristics. In some embodiments, the polymer is polypropylene. In other embodiments, polystyrene and other polymer materials may also be used.

As is evident from the foregoing, the tape dispenser 100, 200 is adapted to allow a user to only use one hand to hold the tape dispenser and dispense a length of tape on an application surface from the roll of tape 104. The tape dispenser 100 comprises a one-piece frame molded from a polymeric material having two generally planar sidewalls 118, 120 with inwardly projecting hub portions 140 and 141. The two sidewalls are interconnected by the tape guide portion 108 which carries the cutting blade and may be locked together via structures located on the tabs of the hub portions.

Figure 9:
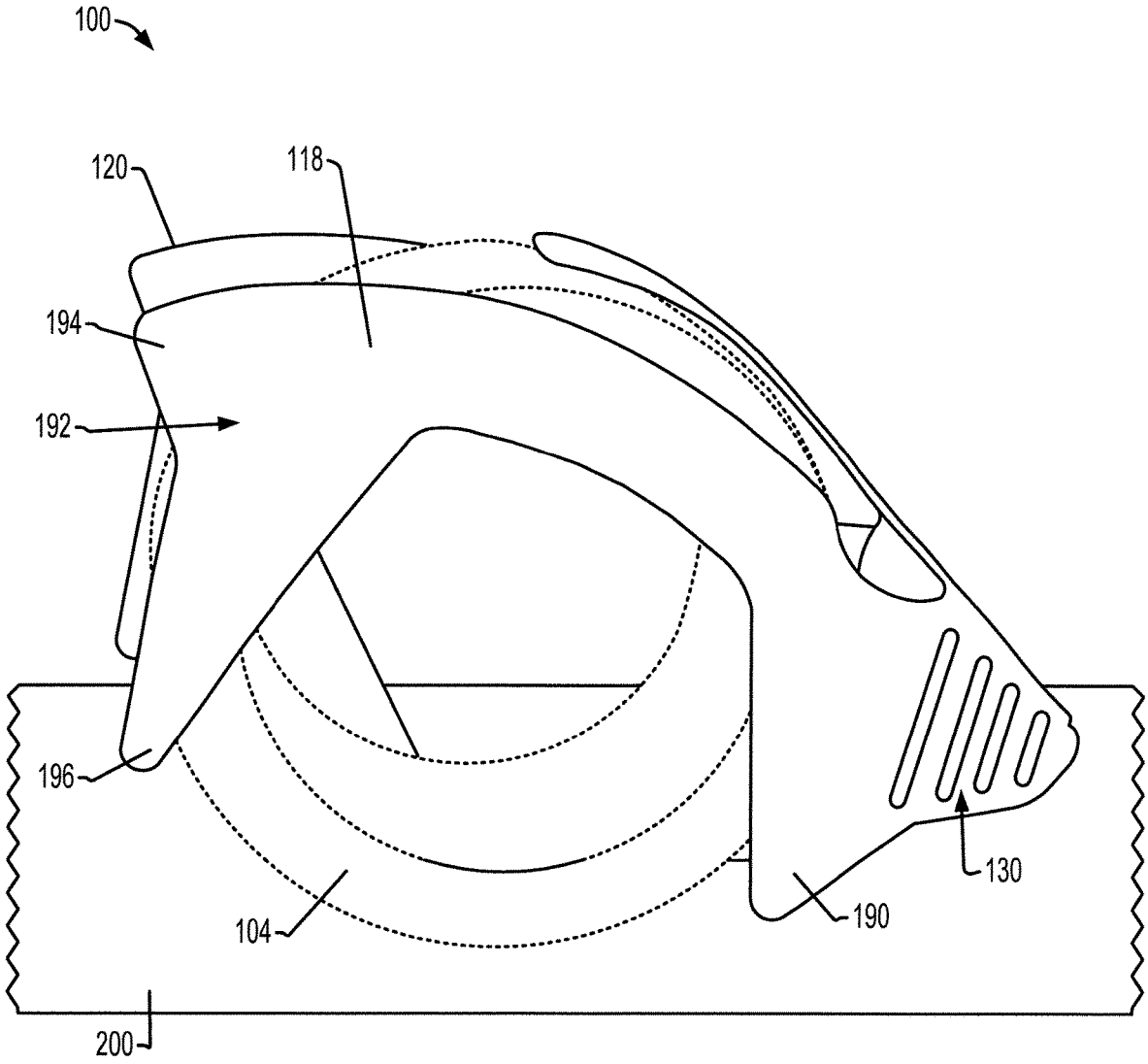
FIG. 9 illustrates a first configuration wherein front foot portions and the tape roll provide a stable resting position.
Figure 10:
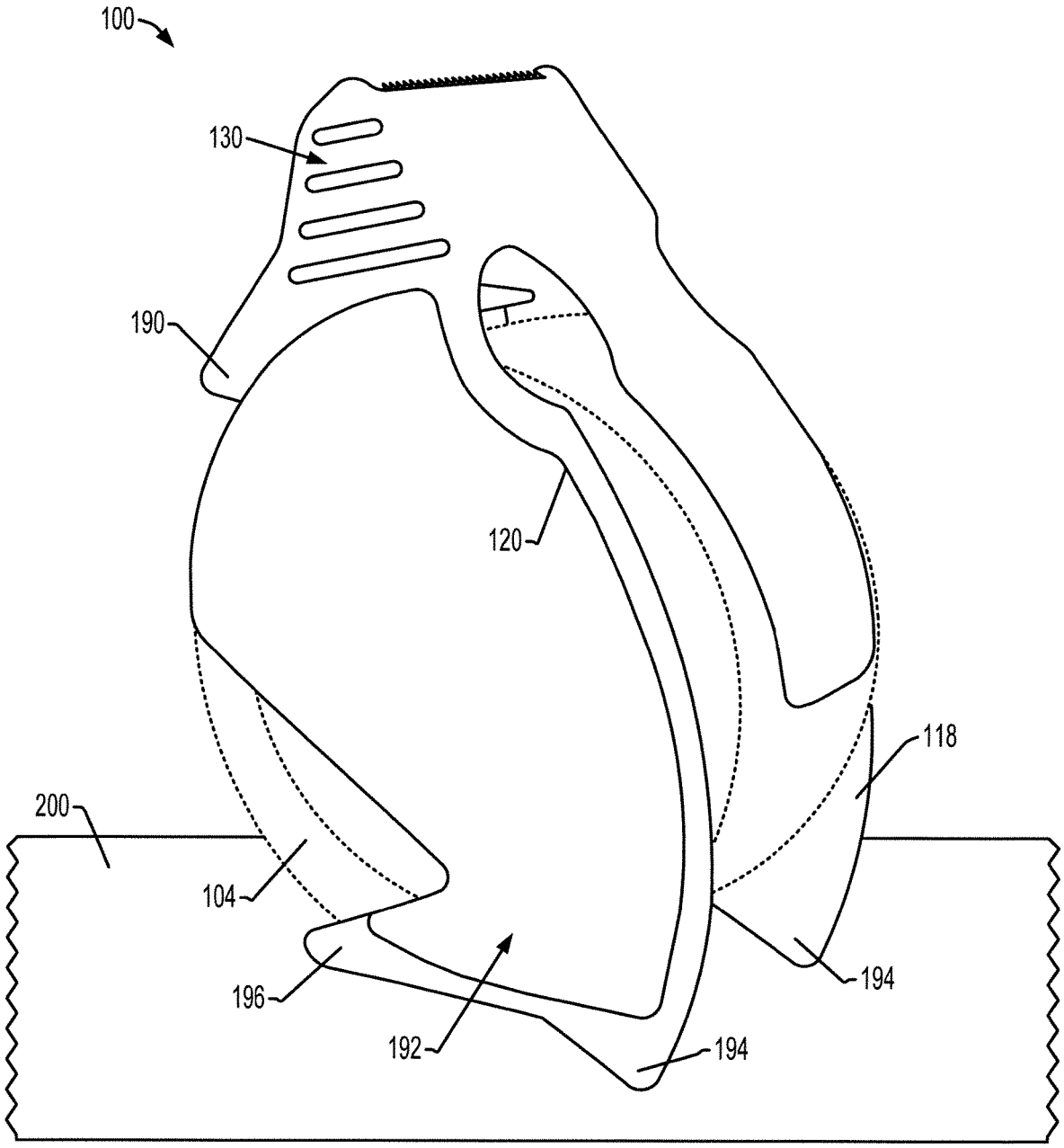
FIG. 10 illustrates a second configuration wherein the top legs and bottom legs of the rear foot portion provide a resting position.

With reference to FIGS. 4, 9-10, the dispenser may dispense tape in a handheld position or in a standing position. The design of the sidewall arm portions 118 and 120 allows for the device to have several resting positions/orientations. Each sidewall portion 118 and 120 includes downwardly extending front foot portions 190 and rear foot portions 192. The front foot portions 190 are located about the front tape guide portion 108 of the device and allow the tape dispenser 100 to be placed on a surface 200 in a stable position protecting the adhesive side of the end of the roll of tape. As illustrated in FIG. 9, in a first resting configuration, the front foot portions 190 and tape roll 104 provide stability to the device.

The rear foot portions 192 are located at the rearmost end of the flexible sidewall arms 118 and 120. The rear foot portions include top legs 194 and bottom legs 196. As illustrated in FIG. 10, in a second resting configuration, the top legs 194 and bottom legs 196 of the rear foot portion 192 provide stability for the device 100 to stand on a surface.

In some embodiments disclosed herein, the front edge of the forward tape guide portion comprises at least one cutting blade disposed along a length of the front edge.

In some embodiments disclosed herein, the device further includes a pair of inwardly facing opposed projections located on the interior surfaces of the first and second flexible sidewall arm portions about the forward tape guide portion.

In some embodiments disclosed herein, the device further includes a grip portion disposed on the exterior surface of both the first and second flexible sidewall arm portions about the forward tape guide portion.

In some embodiments disclosed herein, the passage includes an elongated slot.

In some embodiments disclosed herein, the roll surfaces of the first and second hub portions include a central recess configured to receive a roll of tape, wherein ridges present on the edges of the central recess secure a received roll of tape.

In some embodiments disclosed herein, the roll surfaces of the first and second hubs further include at least one side spacer.

In some embodiments disclosed herein, the device further includes a pair of legs located about a rear end of the first and second flexible sidewall arm portions.

In some embodiments, disclosed herein, the frame further includes a cantilevered arched portion connected to and extending rearwardly from the forward tape guide portion configured to extend partially around an installed roll of tape. In some embodiments, the cantilevered arched portion has a generally cylindrically concave surface adjacent to the first and second hubs.

In some embodiments disclosed herein, the device further includes first and second front legs located on the first and second sidewall portions, respectively.

In some embodiments disclosed herein, each of the first tab and second tab include complementary angled sidewalls which abut each other when the first tab is engaged with the projection. In some embodiments, the angled sidewalls encourage the alignment of the passage with the projection during installation of tape rolls.

In some embodiments, the second tab includes a passage and the second hub portion, similarly to the first tab, includes a projection.

In some embodiments disclosed herein, a plurality of side spacers are disposed on the roll surface of the first and second hub portions and are adjacent to the interior sidewall surfaces.

In some embodiments disclosed herein, the device includes a pair of ridges disposed on the roll surfaces of the first and second hub portions adjacent to the interior sidewall surfaces, wherein the pair of ridges define a central recess dimensioned to receive and secure a roll of tape.

The exemplary embodiments has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

The invention claimed is:

1. An adhesive tape dispenser comprising:

a frame including a forward tape guide portion having a generally planar top tape guide surface, a front edge, a first side edge and a second side edge;

first and second flexible sidewall arm portions disposed generally perpendicular to the generally planar top guide surface and extending rearwardly in a generally side-by-side spaced apart relation from the first side edge and second side edge, respectively, the first and second flexible sidewall arm portions each having an interior surface and an exterior surface;

inwardly facing opposed first and second hub portions projecting from the interior surface of the first and second flexible sidewall arm portions, respectively, the first and second hub portions having a generally arcuate shape and including a roll surface, a bottom surface, and an abutment surface, wherein the abutment surface connects the roll surface to the bottom surface, and wherein the roll surface is configured to support core upon which the adhesive tape is disposed;

a first tab disposed on the bottom surface of the first hub portion extending inwardly toward the second hub portion, the first tab including a passage configured to receive a projection disposed on the bottom of the surface of the second hub portion;

a second tab disposed on the bottom surface of the second hub spaced apart from the projection, the second tab extending inwardly toward the first hub portion and configured to slidably contact the bottom surface of the first hub; and wherein when the first tab is engaged with the projection, the abutment surfaces of the first and second hubs are in contact.

2. The device according to claim 1 wherein the front edge of the forward tape guide portion comprises at least one cutting blade disposed along a length of the front edge.

3. The device according to claim 2, further comprising a pair of inwardly facing opposed projections located on the interior surfaces of the first and second flexible sidewall, arm portions between the roll surface and the cutting blade the forward tape guide portion.

4. The device according to claim 1, further comprising a grip disposed on the exterior surface of both the first and second flexible sidewall arm portions.

5. The device according to claim 1 wherein the passage comprises an elongated slot.

6. The device according to claim 1, wherein the roll surfaces of the first and second hub portions comprise a central recess surface configured to receive a roll of tape, wherein a ridge on the edges of the central recess secure a received tape roll.

7. The device according to claim 1, wherein the roll surfaces of the first and second hubs further comprise at least one side spacer.

8. The device according to claim 1 further comprising a pair of legs located adjacent a rear end of the first and second flexible sidewall arm portions.

9. The device according to claim 1 wherein the frame further comprises a cantilevered arched portion extending rearwardly from the forward tape guide portion configured to extend partially around an installed roll of tape.

10. The device according to claim 9, wherein the cantilevered arched portion includes a generally cylindrically concave surface adjacent to the first and second hubs.

11. The device according to claim 1, further comprising a first, and, second front leg located on the first and second sidewall portions respectively.

12. The device according to claim 1, wherein each of said first tab and said second tab include complementary angled sidewalls which abut each other when the first tab is engaged with the projection.

13. The device according to claim 12, wherein said angled sidewalls encourage the alignment of the passage with the projection during installation of the tape rolls.

14. The device according to claim 1, wherein second tab includes a passage and the second hub portion includes a projection.

15. The device according to claim 1, further comprising a plurality of side spacers disposed on the roll surface of the first and second hub portions adjacent to the interior sidewall surfaces.

16. The device according to claim 1, further comprising a pair of ridges disposed on the roll surfaces of the first and second hub portions adjacent to the interior sidewall surfaces, wherein the pair of ridges define a central recess dimensioned to receive and secure a tape roll.

17. An adhesive dispenser comprising:

a frame including a forward tape guide portion having a generally planar op tape guide surface, a front edge, a first side edge and a second side edge;

first and second flexible sidewall arm portions disposed generally perpendicular to the generally planar top guide surface and extending rearwardly in a generally side-by-side spaced apart relation from the first side edge and second side edge, respectively, the first and second flexible sidewall arm portions each having an interior surface and an exterior surface;

inwardly facing opposed first and second hub portions projecting from the interior surface of the first and second flexible sidewall arm portions, respectively; the first and second hub portions of generally arcuate shape having a roll surface, a bottom surface, and an abutment surface, wherein the abutment surface connects the roll surface to the bottom surface, and wherein the roll surface is configured to support the roll thereon;

a first tab having angled sidewalls disposed on the bottom surface of the first hub portion extending inwardly toward the second hub portion, a second tab having angled sidewalls complementary to the angled sidewalls of the first tab disposed on the bottom surface of the second hub configured to slidably contact the bottom surface of the first hub; and wherein when the first tab includes a locking structure configured to engage a complementary locking structure located on the bottom surface of the second hub portion such that when the locking structure is engaged with the complementary locking structure the abutment surfaces of the hub are in direct contact.

18. A method for loading and unloading a roll of tape from a tape dispenser comprising:

providing a dispenser comprising:

a frame including a forward tape guide portion having a generally planar top tape guide surface, a front edge, a first side edge and a second side edge;

first and second flexible sidewall arm portions disposed generally perpendicular to the generally planar top guide surface and extending rearwardly in a generally side-by-side spaced apart relation from the first side edge and second side edge, respectively, the first and second flexible sidewall arm portions each having an interior surface and an exterior surface;

inwardly facing opposed first and second hub portions projecting from the interior surface of the first and second flexible sidewall arm portions, respectively; the first and second hub portions of generally arcuate shape having a roll surface, a bottom surface, and an abutment surface, wherein the abutment surface connects the roll surface to the bottom surface, and wherein the roll surface is configured to, support the roll thereon;

a first tab having angled sidewalls disposed on the bottom surface of the first hub portion extending inwardly toward the second hub portion, a second tab having angled sidewalls complementary to the angled sidewalls of the first tab disposed on the bottom surface of the second hub spaced apart from the projection extending inwardly toward the second hub configured to slidably contact the bottom surface of the first hub;

wherein when the first tab includes a locking structure configured to engage a complementary locking structure located on the bottom surface of the second hub portion such that when the locking structure is engaged with the complementary locking structure the abutment surfaces of the hub are in direct contact; and manipulating, via a finger of a user, the first tab such that the locking structure and complementary locking structure disengage allowing for the hub portions to be separated by a distance such that a roll of tape may be installed or removed from the dispenser.

19. The method of claim 18, wherein said angled sidewalls encourage the alignment of the passage with the projection during installation of the tape rolls.

* * * * *